United States Patent [19]

Lane

[11] Patent Number: 4,883,433

[45] Date of Patent: Nov. 28, 1989

[54] ELECTRICAL CONNECTOR FOR DATA DISTRIBUTION PANEL

[75] Inventor: David Lane, Greensboro, N.C.

[73] Assignee: AMP Incorporated, Harrisburg, Pa.

[21] Appl. No.: 136,090

[22] Filed: Dec. 21, 1987

[51] Int. Cl.[4] ..... H01R 13/00

[52] U.S. Cl. ..... 439/607

[58] Field of Search ..... 439/607-610, 439/535, 536, 557

[56] References Cited

U.S. PATENT DOCUMENTS 4,711,507 12/1987 Noorily ..... 439/557 X

*Primary Examiner*—Paul Gensler

*Attorney, Agent, or Firm*—Eric J. Groen

[57] ABSTRACT

An electrical connector is disclosed which is for use with a patch cable on a data distribution panel. Connectors are placed at each end of the cable and can be latchably interconnected to the panel to interconnect shielded subassemblies together. A data distribution panel includes a conductive panel having openings for the receipt of shielded electrical data connectors from the rear thereof and are electrically commoned to the panel. The electrical connectors are in the form of shielded subassemblies which, when interconnected to the panel, are commoned by a finger which extends from the panel thereby contacting the subassemblies.

8 Claims, 7 Drawing Sheets

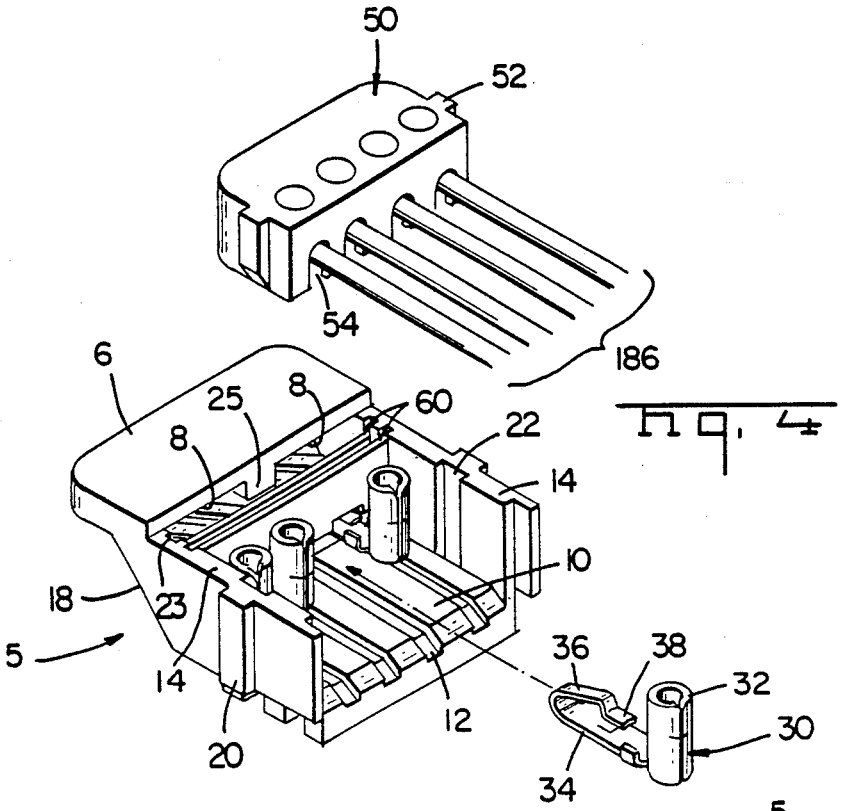
Fig. 4
Fig. 5
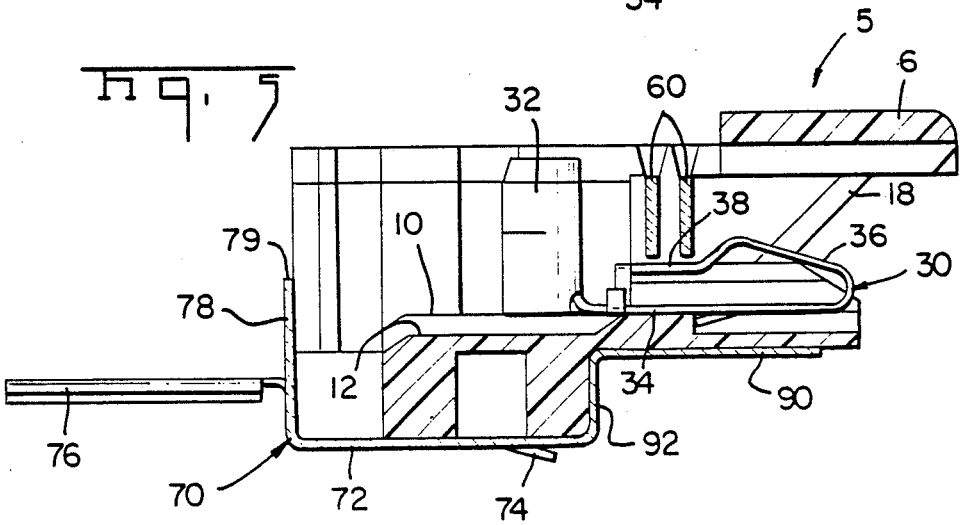

ELECTRICAL CONNECTOR FOR DATA DISTRIBUTION PANEL

BACKGROUND OF THE INVENTION

1. Field of the Invention

The invention relates to a data distribution panel for the selective interconnection of shielded cables to and from different destinations, and more particularly to electrical connectors for use with data distribution panels.

2. Description of the Prior Art

U.S. Pat. No. 4,501,459 discloses a local area network connector specifically intended for use in the data communications industry. These connectors can be employed in a closed loop data communications link in which various equipment such as computer terminals can be interconnected in a system. These connectors are specifically adapted for use in interconnecting numerous micro or mini computers in a computer network in an office environment. Connectors of this type have standard must also be shielded to prevent spurious electrical signals and noise from affecting the signals in the network.

The structure and components of local area network connectors of this type is represented by the structure of the connector shown in U.S. Pat. No. 4,501,459. These connectors include a plurality of spring metal terminals having insulation displacement wire barrels for establishing electrical connection with the individual conductors forming the multi conductor shielded cable. Terminals are positioned on a support housing and upper and lower shields can be positioned in surrounding relationship to the terminals and the support housing. Shield members are permanently attached to upper and lower cover members and the cover members are mated to both encapsulate the conductor and to common the upper and lower shields to the cable shielding.

Similar data connectors of this type are shown in U.S. Pat. Nos. 4,449,778; 4,508,415; 4,582,376; 4,602,833; 4,519,494; 4,653,825; 4,641,906; 4,671,599; and 4,682,836.

These above mentioned connectors are utilized with data distribution systems where the various distribution end points are subject to change. For example, several computer terminals could be interconnected to various associated printing stations. If the data cable is continuous between a first point, which could be a terminal, and between a second end, which could be a printing station, the cable would have to be severed at some position within the cable length to interconnect one terminal to a different printing station.

For this reason, data distribution panels are incorporated within the system acting as links to the various end points. These panels are located intermediate the destinations, typically in a wiring closet, and include shielded cable coming from one destination, such as a terminal, which is terminated to an electrical connector and mounted within a panel. A second shielded cable coming from a second destination, such as from a printing station, is interconnected to a second electrical connector and the second electrical connector is mounted within the panel adjacent to the first electrical connector. A patch cable is utilized which includes a short length of shielded data cable having two electrical connectors at opposite ends which are matable with the first and second electrical connectors mounted within the panel. In all likelihood, a mass array of first electrical connectors and a mass array of second electrical connectors are disposed in a matrix and mounted to the panel. Several patch cables are available to change and interconnect, the various interconnections possible between the first and second connectors.

Typical distribution panels include connectors of the type disclosed in U.S. Pat. No. 4,501,459 where an array of cables and connectors are centralized into the distribution panel. Patch cables which interconnect the various connectors include similar shielded cable with similar connectors electrically interconnected to ends of the cable. The connectors shown in U.S. Pat. No. 4,501,459 are hermaphroditic and therefore identical connectors can be utilized for the distribution panel and for the patch cables.

A requirement of these distribution panels is that the shielded cable of the first and second cables is commoned together and to the conductive panel to which the first and second connectors are mounted. To accomplish this, the present designs of distribution panels include conductive mounting towers or blocks, which are situated behind, and spaced from, a front face of the panel, and include conductive grounding clips mounted thereto. The insulation of the shielded cable must be stripped off of the cable for a distance equal to the spacing from the rear face of the panel to the ground clips. The exposed shield of the cable is then inserted within the grounding clips on the towers to interconnect the shielding braid to the conductive panel.

The use of this connector in combination with the requirement for this method of grounding the shielding, accounts for an expensive assembly and for a large space requirement on the distribution panel.

SUMMARY OF THE INVENTION

The objects of the invention relate to reducing the overall cost of this type of installation by reducing the cost of the components which are included within the system.

A further object relates to the design of a connector system for use with the distribution panel which will reduce the overall profile of the distribution panel.

More particularly, an object of the invention is to design a less expensive electrical connector which can be electrically interconnected to the distribution panel and snap latch to the panel.

The objects of the invention were accomplished by designing an electrical connector which includes a shielded subassembly having an insulative housing means having terminal supporting means including a platform for the receipt of a plurality of electrical terminals, and sidewalls upstanding from the platform, the platform and the sidewalls defining an open upper face of the housing means. Disposed within the housing is a plurality of electrical terminals including base portions for mounting on the platform in transition with reversely bent portions forming resilient contact portions, the contact portions extending rearwardly to free ends of the terminals, the contact portions being intermatable with like contact portions in a complementary connector, the terminals further comprising wire connecting portions extending from ends of the terminal base portions. The shielded subassembly also includes an insulative cap member, securable within the housing means, including means for aligning individual wires of the shielded cable with selected wire connecting portions. To shield the insulative housing means the subassembly includes shield means securable to the housing means, which substantially encloses the exterior of the sidewalls, the exterior of the platform, and the open upper face of the platform, thereby overlying the terminal wire connecting portions, the insulative cap member providing a spaced relation between the shield means and the wire connecting portions of the terminals. The connector also includes an insulative cover means which is received over the shielded subassembly and which is snap latchable to a panel.

BRIEF DESCRIPTION OF THE DRAWINGS

FIG. 3A is an isometric view of the shielded subassembly in an exploded configuration.

FIG. 3B is an isometric view of the shielded subassembly in an assembled configuration.

FIG. 4 is an isometric view of the housing of the shielded subassembly.

FIG. 5 is a cross-sectional view of the insulative housing with the lower shield in place. FIG. 6 is an exploded view showing the connector assembly.

FIG. 8 is a cross sectional view through lines 8—8 of FIG. 2.

DETAILED DESCRIPTION OF THE PREFERRED EMBODIMENT

The instant invention relates to an electrical data connector which is mountable to a panel. The best mode contemplated is for use of the electrical data connector within a data distribution system and more particularly for uses at opposite ends of a patch cable which will be used within the data distribution system. Thus, the data distribution system will first be described in order to fully understand the environment in which the connector will be used. The system is described more fully in co-filed patent application Ser. No. 136,220, entitled "Data Distribution Panel", refiled as Continuation application Ser. No. 323043, the subject of which is incorporated herein by reference.

Figure 1:
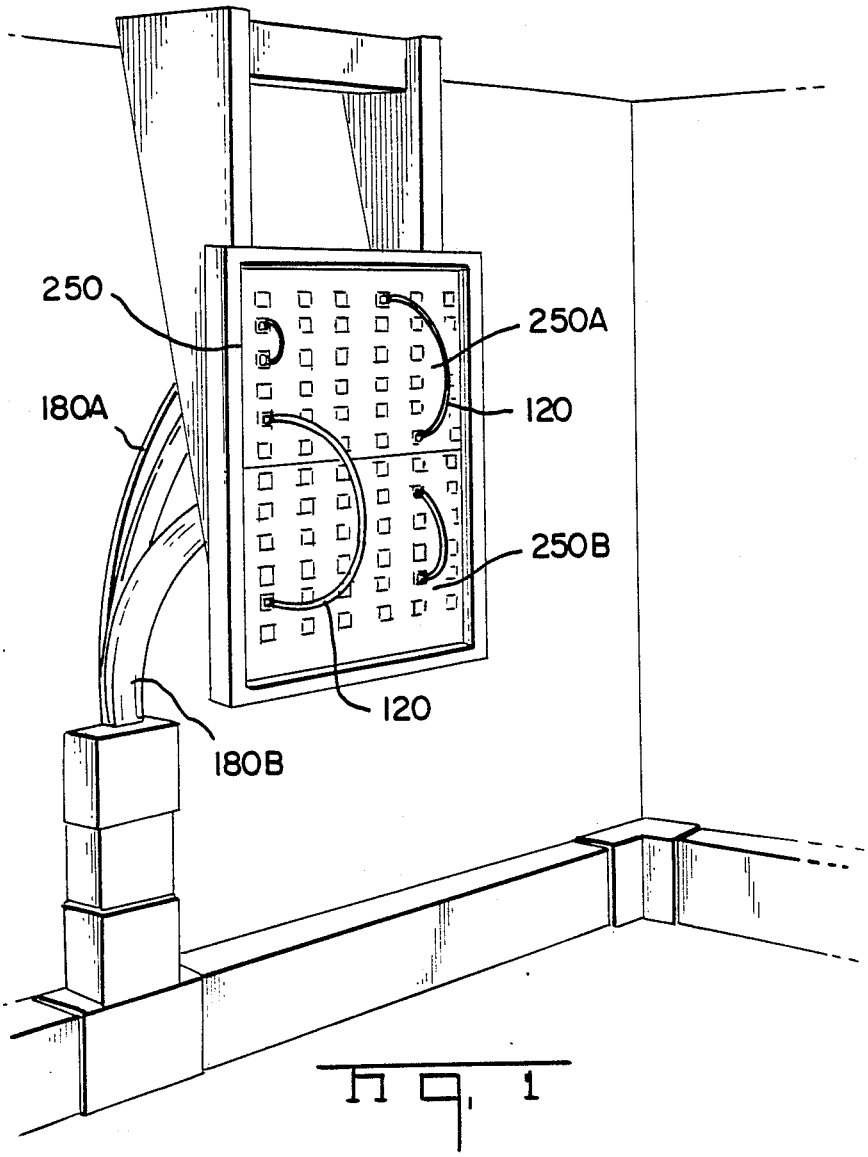
FIG. 1 is a pictorial view of the data distribution panel in which the connector of the instant invention will be used.

Referring first to FIG. 1 shows the data distribution panel as generally including a conductive panel, such as 250, which would include upper and lower panels, such as 250*a* and 250*b*. Shielded data cable, such as 180*a* and 180*b*, would be terminated to an electrical connector and latched to the rear of the panels 250*a* and 250*b*, and each of the shielded data cables 180*a* and 180*b* would be terminated at their opposite ends to a user point. It should be noted that all cables such as 180*a* follow a similar route through a building to a similar destination while the cables such as 180*b* follow an opposite route and terminate in another location. It is typical then that all connectors which connect to cables 180*a* are grouped into an array of connectors within one panel, such as 250*a*, while all connectors which interconnect to cables such as 180*b* are grouped into a second similar array of connectors within a panel such as 250*b*. However it should also be noted that such a grouping is not requisite for the type of distribution panel discussed herein, but is only mentioned as illustrative to a typical distribution panel.

Figure 2:
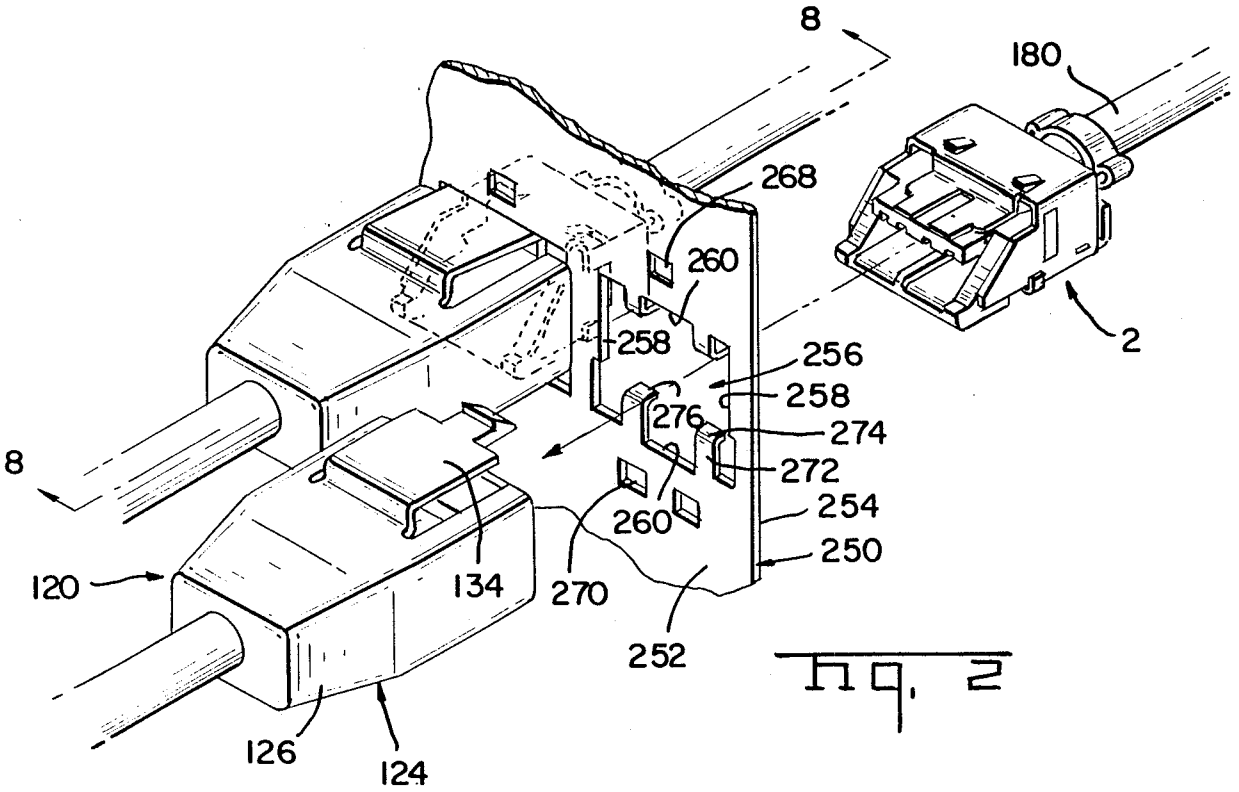
FIG. 2 is an isometric view of the data panel showing the connector of the instant invention poised for receipt.
Figure 9:
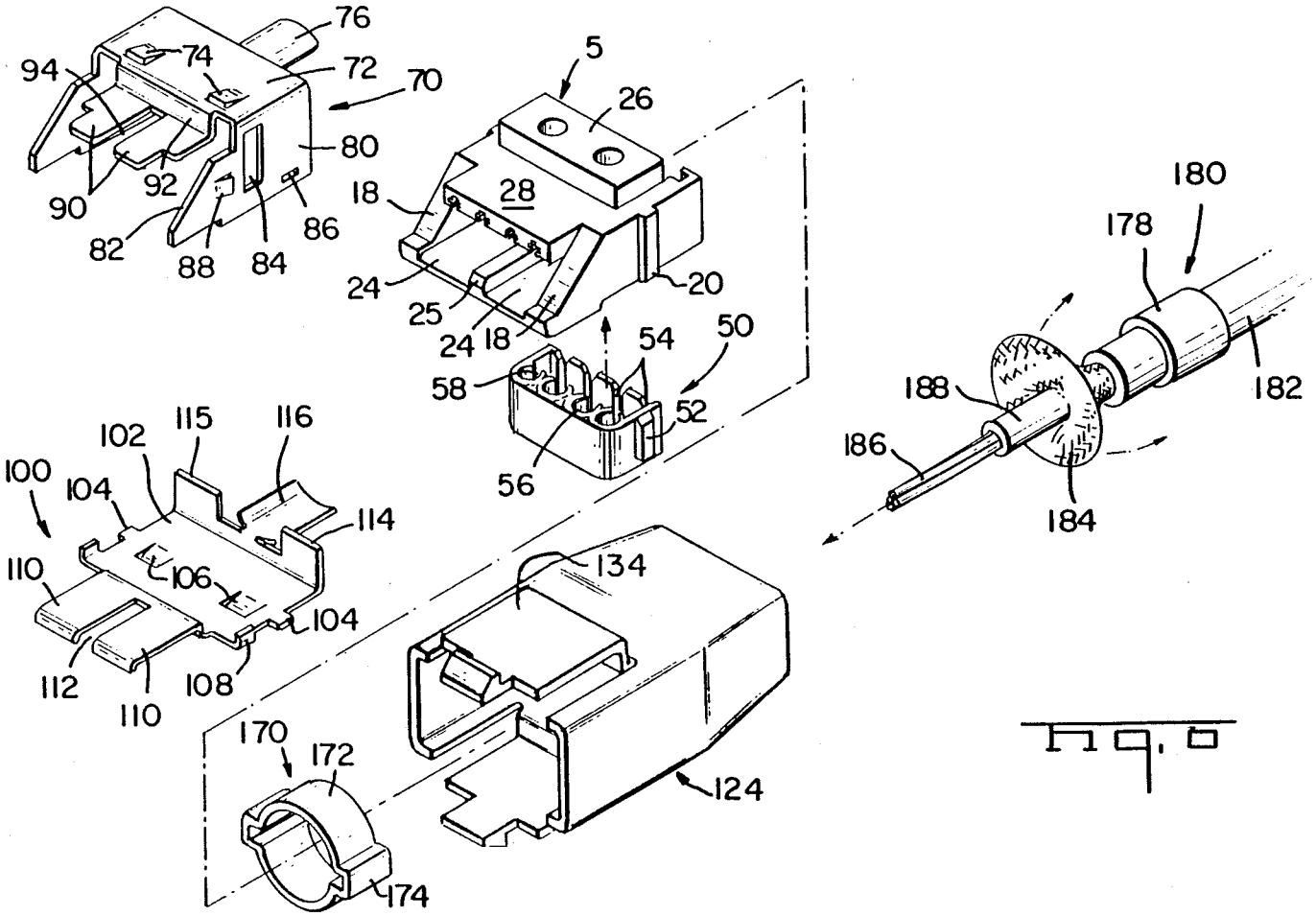

Patch cables, such as 120, are included which electrically interconnect a selected shielded data cable 180*a* to a selected shielded data cable 180*b*. The electrical interconnection between data cables 180*a* and 180*b* may be changed by merely disconnecting one or both ends of the patch cable 120 and selecting a new interconnection point to a new shielded data cable. With reference now to FIG. 2, the conductive panel will be described in greater detail, although the description will be to a conductive panel generally termed 250 and will be identical whether used as panel 250*a* or 250*b*.

Conductive panel 250 includes a front mating face, such as 252, and a rear face 254 having a plurality of connector receiving openings 256 therein. Each of the openings 256 is generally defined by sidewalls 258 and upper and lower walls 260. A plurality of fingers 272 extend upwardly and downwardly, respectively, from the lower and upper walls 260, and each finger 272 includes a contact portion 274 and a free end 276.

Referring now to FIGS. 3A-4, the shielded subassembly 2 generally includes a housing member 5, a stuffer cap 50, and shield members 70 and 100. The data connector housing 5 will be described in greater detail, with reference to FIGS. 3A and 4.

With reference first to FIG. 4, the housing 5 generally comprises a terminal support floor 10 having a plurality of channels 12 therein for receiving terminals 30. Extending upwardly from the terminal support floor are sidewalls 14 having internal grooves 22 and external ribs 20. A bridge portion 6 extends across the two sidewalls and below the bridge 6 is a rib 25 which extends from the rear edge of the bridge (FIG. 4) to the forward edge of the bridge (FIG. 3A). The rib 25 defines two windows 8 which also extend from the rear edge of the bridge to the forward edge of the bridge to define two shield receiving surfaces 24 (FIG. 3A). The sidewalls 14 extend from the rear of the data connector 5 to the front mating face of the data connector to define two 45 degree surfaces at the front mating face, referred to generally as 18.

Terminals 30 include insulation displacement wire barrels 32, a blade portion 34, a resilient contact portion 36 and a commoning foot 38. The resilient contact portion 36 is looped back upon itself and spaced above the terminal support floor. The resilient contact portion 36 is disposed at the front mating face of the housing 5 for overlapping interconnection with like terminals, the two resilient contact portions of mating connectors contacting each other to deflect respective resilient contact portions towards the blade portion of respective terminals.

Stuffer cap 50 includes alignment ribs 52 along the sides, wire receiving slots 54 and stuffers cylinders 56, the stuffer cylinders 56 having an inside diameter larger than the outside diameter of the barrels 32 of the terminals 30.

Referring now to FIG. 3A, the shield member 70 includes a plate member 72 with continuous shield members 90 extending from the plate member 72 through a bent portion 92, the two shield members 90 defining a slot 94 therebetween. The plate member 72 further includes two locking lances 74. The shield member 70 is shown in FIG. 5 as including a rear wall 78 extending from the plate member 72 with a semicircular shielding tail 76 extending from the rear wall 78. With reference again to FIG. 3A, the shield member 70 further includes integral sidewalls 80 having apertures 84 and 86 stamped therefrom. The forward edges of the sidewalls 80 are defined by two 45 degree surfaces 82.

Shield member 100 is shown as including a plate member 102 with integral shielding portions 110 extending from the front edge thereof, the two shield members 110 defining a slot 112 therebetween. The shield member 100 further includes a rear wall portion 114 having a semicircular shield tail 116 extending from the rear wall 114. Plate member 102 further comprises locking lances 106, and tabs 104 and 108 extending from the side edges thereof.

The assembly further includes a ferrule 170 having semicircular portions 172 and collapsible portions 174. The shielded cable 180 includes outer insulation 182, a shielding braid 184, inner insulation 188 and individual insulated conductors 186.

To interconnect the shielded cable 180 to the electrical terminals, the housing portion 5, of FIG. 4, is first assembled. With the shorting bars 60 removed, the terminals 30 are slidably received in respective channels 12 until latched in place. The shorting bars 60 are then inserted in respective grooves 23, the shorting bars 60 contacting the commoning foot 38 on alternate terminals to common alternate terminals when the data connector 5 is in an unmated condition. Prior to preparing the end of the cable, the collapsible ferrule 170 is slid over the end of the cable and is placed back upon the cable for later use.

The end of the shielded cable can then be prepared by stripping a portion of the outer insulation 182 from the end of the cable to expose a portion of the shield 184, the exposed shielding braid 184 is dressed over the outer insulation 182, as shown in FIG. 3A. Stripping the outer insulation 182 exposes the insulated conductors 186 and each individual wire 186 is placed in the stuffer cap 50 through a respective slot 54, with the ends of the wire 186 extending into the barrels 56 through the slot 58. The stuffer cap 50 and the individual wire 186 are then placed over the insulative housing 5 such that ribs 52 on the stuffer cap 50 are aligned with channels 22 in the insulative housing 5, which in turn aligns the stuffer cap barrels 56 with the insulation displacement wire barrels 32 on the terminals 30. The stuffer cap 50 is then pushed downwardly until each of the individual conductors 186 is terminated within respective wire barrels 32 of terminals 30.

With the conductor terminated, the shield members 70 and 100 can be assembled to the housing. The shield member 70 is first assembled to the insulative housing 5 such that the aperatures 84 in the shield member overlie the ribs 20 on the exterior of the insulative housing. When the shield member 70 is placed over the housing, the shield extension tail 76 overlies the dressed braid 184. The shield member 100 is then assembled to the insulative housing 5 with the shield contact portions 110 disposed within the windows 8 (FIG. 4) of the insulative housing such that the shield contact portions 110 lie adjacent to surface 24, as shown in FIG. 3B. Shield member 100 is held in place to shield member 70 with tabs 104 on each side edge of plate member 102 being disposed within apertures 86 in the sidewalls 80 of the shield member 70. To retain the two sidewalls 80 from outer expansion, two flaps, such as 108, are bent over the sidewalls 80 of the shield member 70 which also retain the downward movement of the flat plate portion 102 of the shield member 100. With the shield member 100 so installed, the shielding extension tail 116 also overlies the shielding braid as the two shielding tails 76 and 116 are complementary semicircular portions.

As installed, the plate member 102 of the shield member 100 overlies the terminals 30 within the connector housing 5. The rear wall 114 of the shield member 100 encloses the rear edge of the connector housing 5 with edge 115 of the rear wall 14 substantially adjacent to edge 79 (FIG. 5) of rear wall 78 to totally enclose the connector housing. Also as installed, the semicircular shield tail 116 overlies and is substantially adjacent to the dressed braid. The previously installed ferrule 170 can then be slid forwardly to overlie the semicircular shield tails 76 and 116, and the ferrule 170 can be crimped to a configuration as shown in FIG. 3B. The collapsible ferrule provides for a permanent electrical connection between the shielding components, that is, the shielding braid 184 is trapped beneath the metallic shield tails 76 and 116.

It should be understood that the above mentioned assembly is compatible with the commercially available data cables, such as Data Cables Types 1, 2, 6 and 9, and with the data cable as disclosed in co-filed patent application Ser. No. 136,046, entitled "Premise Distribution Cable", abandoned.

It should be understood that the assembly as previously described can be installed within the use's facility without any assembly equipment. At most, a pocket knife is required to strip the cable and a pair of pliers is required to push the stuffer cap down to terminate the insulated conductors, and to crimp the ferrule 170.

With the shielded subassembly 2 assembled as previously described, the shielded subassembly is prepared for receipt within the conductive panel 250. A shielded subassembly 2 can be inserted through the rear face 254 into each of the openings 256 such that the tabs 88 on either side of the shielded subassembly snap past the sidewalls 258 (shown in phantom in FIG. 8) retaining the shielded subassembly from moving in one direction. The fingers 272 which extend from the upper and lower edges 260 of the conductive panel 250 serve two functions. First, the free ends 276 of the fingers 272 abut the ends of the tabs 74 and 106, as shown in FIG. 8, which retain the shielded subassembly from moving forward within the openings 256 of the conductive panel 250. Thus the tabs 88, 74 and 106 cooperatively retain the shielded subassembly 2 in retention within the conductive panel 250. Second, the fingers 272 have contact portions 274 which abut the upper and lower shield portions, thereby commoning the shielded subassembly 2 to the conductive panel 250. With the conductive panel 250 fully loaded with a mass array of shielded subassemblies 2, the distribution panel can be programmed by the use of patch cables 120 to direct the interconnections between shielded cables, such as between data cables 180*a* and 180*b* shown in FIG. 1.

With reference to FIG. 6, the data connector of the instant invention and the patch cable will be described in detail. The patch cable 120 can generally include an insulative housing, such as 124, which incorporates therein a shielded data cable 180 which is similar and complementary with the data cable which is used in the data distribution panel. The inner core of the path connector 122 is identical to the shielded subassembly 2 which was previously described.

Figures 7A, 7B:
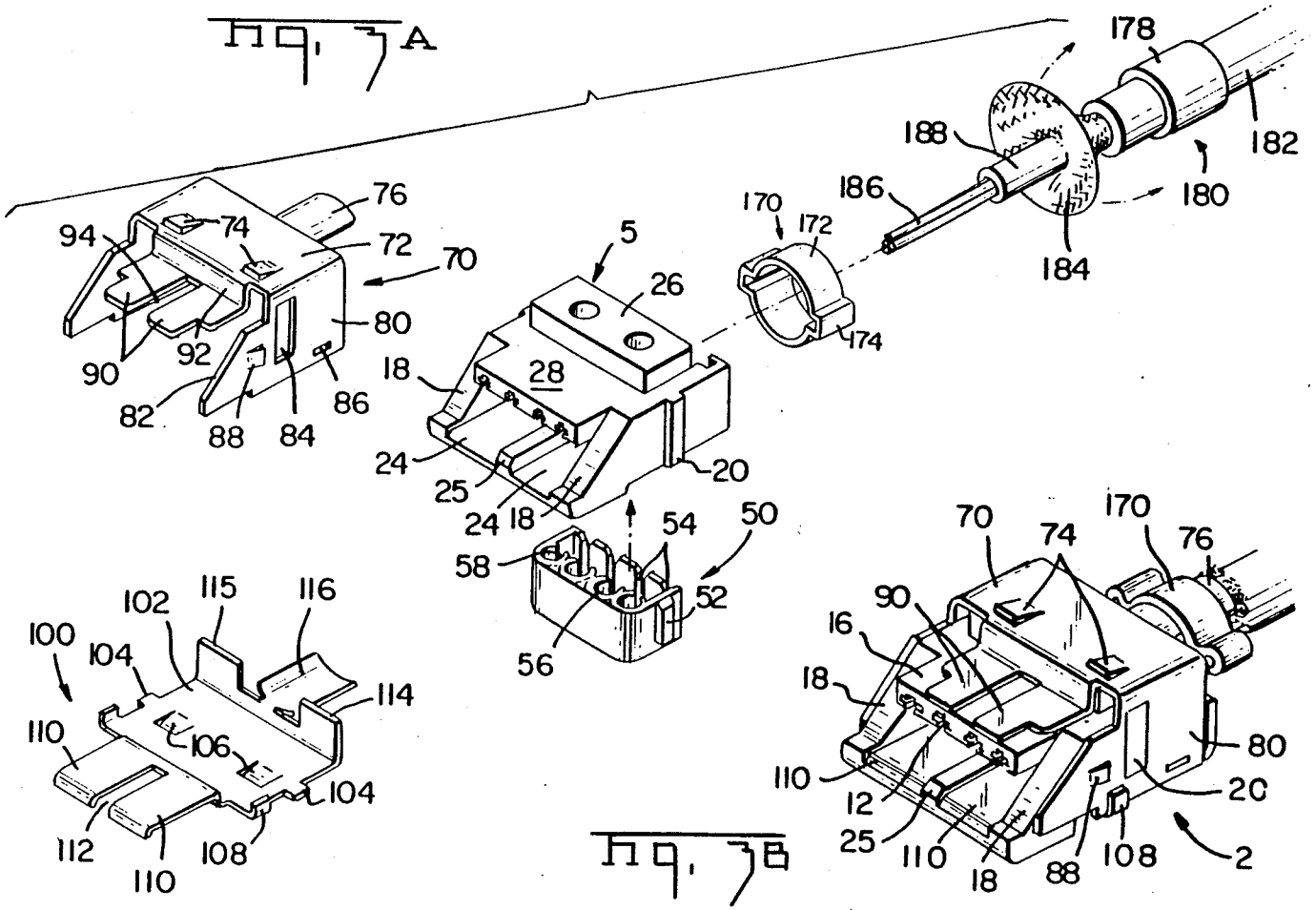
FIG. 7 is an isometric view of the insulative housing of the instant invention partially broken away to show the internal structure.
Figure 7:
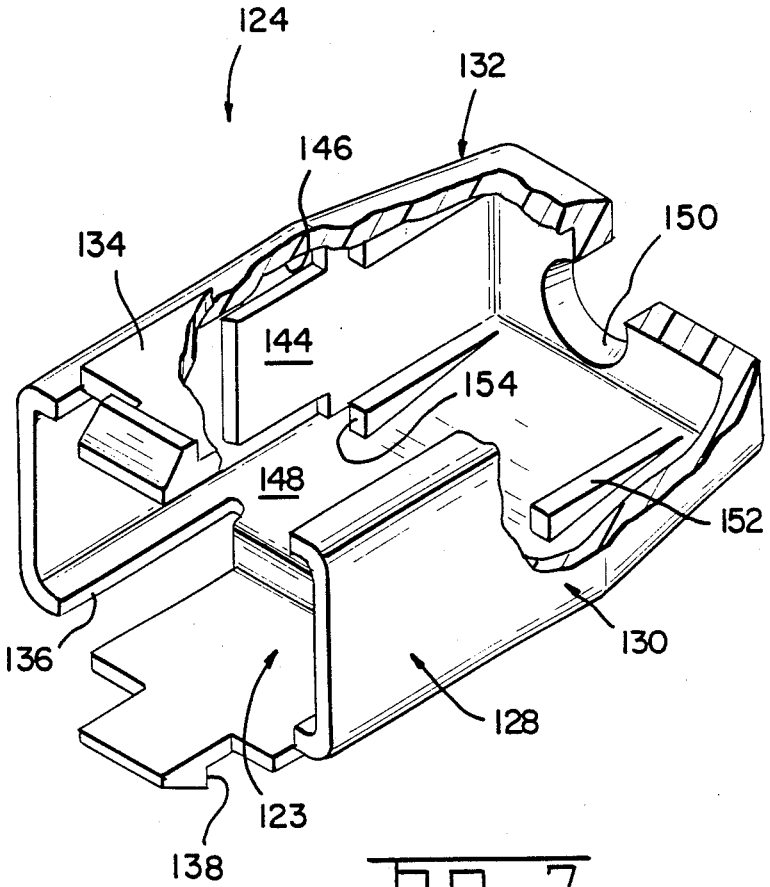
Figure 1:
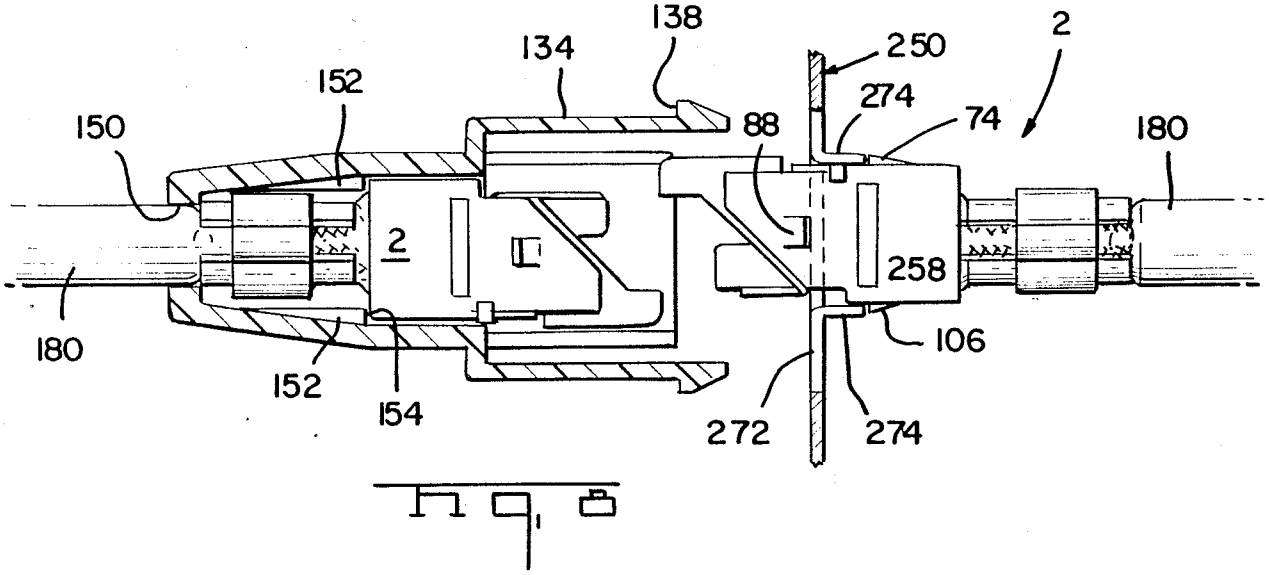

With reference to FIG. 7, the insulative housing 124 would generally include a connector receiving cavity, such as 123, having sidewalls 144 and a lower floor 148 with an upper wall 146. The housing generally includes a forward latching portion 128, a central body portion 130 and a rear cable receiving section 132. The rear portion 132 includes two ribs, such as 152, disposed on the lower and the upper walls having stop surfaces such as 154. The rear wall of the insulative housing 124 has a cable receiving opening, such as 150 therethrough, for the entry of the shielded data cable, such as 180.

The patch cables 120 would be similarly assembled as the shielded subassemblies previously described, although the shielded data cable 180 must be inserted through the cable receiving opening 150 of the insulative housing 124 prior to its preparation. After the cable is inserted through the opening 150, a collapsible ferrule 170 is placed over the end of the cable. The outer insulation could then be stripped and the shielded braid, such as 184, is dressed over the outer insulation 182. The conductors, such as 186, are then terminated to the respective terminals 30 as previously described with reference to the assemblance of the shielded subassemblies 2. It should be noted that one of the connectors 122 will be at each end of the patch cable for interconnection to selected shielded subassemblies 2 in the panel 250. Once the shielded subassemblies at each end of the patch cable are assembled, the insulative housing 124 can be slid forwardly until the rear walls of the shield members 70 and 100 abut the stop surfaces 154 of the housing. The shielded subassembly 2 and the housing 124 are interferingly fit such that the struck out tabs 74 and 106 are deflected inwardly which retain the shielded subassemblies 2 within the insulative housing. It should be noted that by having the shielded subassemblies interference fit within the housings, that the housings can be molded from a single draw mold which greatly simplifies the molding procedures and which greatly reduces the cost of the molds to be produced. Said differently, the housings 124 do not require latching shoulders to retain the housings in place, latches which would require side draw dies within the mold.

With the patch cables fully assembled, the patch cables 120 can be interconnected to selected shielded subassemblies 2 contained within the data distribution panel 250 to interconnect selected data cables **180*a* to 180*b*. As shown in FIG. 2, the latches 134 are resiliently deflectable inwardly such that upon movement of the housing 124 into registration with the conductive panel 250, the latches bias inwardly until the latch surfaces 138 (FIG. 7) are engaged with the rear face 254** of the conductive panel.

It should be noted from FIGS. 2 and 8 that a portion of the shielded subassemblies 2 project from the rear of the conductive panel 250 through the front face of the panel. The housings 124 were designed such the shielded subassemblies 2 within the housings were slightly recessed therein. This allows a flush mount fit of the housings 124 against the front face 252 of the panel 250, as shown in FIG. 2, insulating those portions of the shielded subassemblies which project through the rear face. The patch cable connectors are easily removable by compressing the upper and lower latch members 134 which releases the data connectors for interconnection to various other shielded subassemblies 2.

The preferred embodiment of the invention was disclosed by reference to the specific drawings herein and with specific reference to the terminology used in the state of the art to which the invention relates in order to illustrate and exemplify the preferred practice of the invention, but not to restrict its scope; the appended claims being reserved to that end.

What is claimed:

1. An electrical data connector for interconnection to an electrically shielded cable, and for the matable interconnection to a data distribution panel, the connector comprising:

(a) a shielded subassembly comprising:

(i) an insulative housing means having terminal supporting means including a platform for the receipt of a plurality of electrical terminals, and sidewalls upstanding from the platform, the platform and the sidewalls defining an open upper face of the housing means, (ii) a plurality of electrical terminals including base portions for mounting on the platform in transition with reversely bent portions forming resilient contact portions, the contact portions extending rearwardly to free ends of the terminals, the contact portions being intermatable with like contact portions in a complementary connector, the terminals further comprising wire connecting portions extending from end of the terminal base portions, (iii) an insulative cap member, securable within the housing means, including means of aligning individual wires of the shielded cable with selected wire connecting portions, (iv) shield means securable to the housing means, and substantially enclosing the exterior of the sidewalls, the exterior of the platform, and the open upper face of the platform, thereby overlying the terminal wire connecting portions, the insulative cap member providing a spaced relation between the shield means and the wire connecting portions of the terminals, the shield means comprising upper and lower shield members each having at least one outward projection therefrom; and (b) an insulative cover means which is slidably received over the shielded subassembly, and includes latch means which are snap latchable to the panel, the housing means includes a one-piece molded member having a central body portion having an internal cavity for receiving the shielded subassembly, the projections on the shield means providing an interference fit between the cover means and the shield means, retaining the cover means and shield means together.

2. The connector of claim 1 wherein the upper and lower shield members have rear walls.

3. The connector of claim 2 wherein the cover means includes a central body portion having an internal cavity for receiving the shielded subassembly, the cavity including a stop surface for abutting relation with the rear walls of the upper and lower shield members.

4. In a data distribution system which comprises a conductive panel having at least one through opening therethrough for the receipt from the rear face of the panel, a shielded electrical panel connector, which includes an insulative housing having a plurality of electrical terminals therein, and the panel connector includes shield means in a surrounding relationship with the housing, the shielded panel connector being disposed within the panel through opening with a portion of the panel connector extending beyond a front face of the panel, the shielded panel connector leaving access through the panel along at least one side edge of the through opening, an electrical data connector which is interconnectable with the panel connector is hermaphroditically matable with the panel connector and comprises a second housing means with a second plurality of electrical terminals therein, with second shield means in a surrounding relationship with the housing, the data connector further comprising a cover means which substantially surrounds the shield means of the data connector and which comprises resilient latching means profiled for receipt through the panel access thereby latching the data connector to the panel in an electrically connected configuration with the panel connector, the cover means comprising a one piece molded member slidably receivable over the second shield means such that the thield* means is slightly recessed within the cover means.

5. The data connector of claim 4, wherein the cover means is profiled for surrounding the portion of the panel connector which extends beyond the front face, and the cover means in profiled for abutting the panel when the data connector and the panel connector are mated thereby insulating the portion of the panel connector which extends beyond the front face.

6. A shielded electrical panel mount connector system, comprising:

a conductive panel having a front face and a rear face and which includes at least one opening therethrough and at least one contact finger which extends into the opening;

a first shielded subassembly which includes an insulative housing having a plurality of electrical terminals disposed therein which are electrically connectable to individual conductors of a first shielded data cable, the first shielded subassembly further comprising shield means in a surrounding relationship with the housing means, the first shielded subassembly including latching means which latchably attach the first shielded subassembly to the panel within the opening, and with the shield means in contact with the contact finger of the panel, a second shielded subassembly which includes a second insulative housing having a second plurality of electrical terminals disposed therein which are electrically connectable to individual conductors of a second shielded data cable, the second shielded subassembly further comprising shield means in a surrounding relationship with the second housing means, and an insulative cover means which is receivable over the second shielded subassembly and includes latching means which are profiled to locate adjacent to the contact finger of the panel to latchable attach the cover means and the second shielded subassembly to the panel in an electrically connected configuration with the first shielded subassembly.

7. The connection system of claim 6 wherein two contact fingers extend from an edge of the opening, providing a spacing between the edge which includes the finger and between the shield means, and the latching means extends intermediate the two contact fingers and within the spacing, the latching means including a rearwardly facing shoulder which latches to the rear face of the panel.

8. The connection system of claim 7 wherein the panel includes two contact fingers extending from an upper edge of the opening and two contact fingers extending from a lower edge of the opening, and the latching means includes two latching members which include rearwardly facing shoulders which latchably attach the cover means to the panel.

* * * * *